US007686258B2

(12) United States Patent
Biagiotti

(10) Patent No.: US 7,686,258 B2
(45) Date of Patent: Mar. 30, 2010

(54) SYSTEM FOR A GREASELESS SWITCH ASSEMBLY

(75) Inventor: Maurizio Biagiotti, Pisa (IT)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/094,478

(22) PCT Filed: Aug. 31, 2006

(86) PCT No.: PCT/US2006/034139

§ 371 (c)(1),
(2), (4) Date: May 21, 2008

(87) PCT Pub. No.: WO2007/067234

PCT Pub. Date: Jun. 14, 2007

(65) Prior Publication Data

US 2009/0045298 A1 Feb. 19, 2009

Related U.S. Application Data

(60) Provisional application No. 60/748,241, filed on Dec. 7, 2005.

(51) Int. Cl.
*E01B 7/00* (2006.01)

(52) U.S. Cl. ..... 246/452; 246/449

(58) Field of Classification Search ..... 246/435 R, 246/449, 450, 451, 452; 348/211, 212, 32, 348/608, 604, 553
See application file for complete search history.

(56) References Cited

U.S. PATENT DOCUMENTS

| | | | | |
|---|---|---|---|---|
| 1,467,327 | A * | 9/1923 | Kelloway | 246/452 |
| 2,827,340 | A * | 3/1958 | Johnson | 384/209 |
| 4,030,783 | A * | 6/1977 | McCloskey | 384/211 |
| 4,842,225 | A * | 6/1989 | Carmes | 246/439 |
| 5,195,703 | A * | 3/1993 | Kais et al. | 246/443 |
| 5,730,395 | A * | 3/1998 | Carmes | 246/448 |
| 5,806,653 | A * | 9/1998 | Ahls et al. | 198/326 |
| 6,325,334 | B1 * | 12/2001 | Achleitner et al. | 246/452 |
| 6,367,982 | B1 * | 4/2002 | Doi et al. | 384/565 |
| 7,341,226 | B2 * | 3/2008 | Biagiotti et al. | 246/449 |
| 2002/0148932 | A1 * | 10/2002 | Biagiotti | 246/415 A |
| 2003/0223667 | A1 * | 12/2003 | Leibowitz | 384/574 |
| 2004/0101225 | A1 * | 5/2004 | Del Rio et al. | 384/553 |

(Continued)

FOREIGN PATENT DOCUMENTS

AT 8 130 U1 2/2006

(Continued)

*Primary Examiner*—S. Joseph Morano
*Assistant Examiner*—Jason C Smith
(74) *Attorney, Agent, or Firm*—GE Global Patent Operation; John A. Kramer, Patent Counsel

(57) ABSTRACT

In a railroad switch for use with intersecting railroad rails and having two switch points interconnected by a switch machine between two switch point assemblies and connected thereto by an operating rod at each end of the switch machine, a system for a greaseless switch point assembly having a mounting clip and a pivot pin for connecting each operating rod to its associated switch point, the greaseless switch point assembly having a bushing proximate a part of the pivot pin that fits within an opening in the mounting clip, and an insertion device extending into the opening proximate the bushing.

6 Claims, 4 Drawing Sheets

U.S. PATENT DOCUMENTS

| | | | | |
|---|---|---|---|---|
| 2005/0116119 | A1* | 6/2005 | Biagiotti | 246/449 |
| 2005/0178929 | A1* | 8/2005 | Biagiotti | 246/449 |
| 2005/0236526 | A1* | 10/2005 | Dowell et al. | 246/415 R |
| 2006/0062501 | A1* | 3/2006 | Shore et al. | 384/211 |
| 2007/0267590 | A1* | 11/2007 | Schlude | 251/251 |
| 2007/0274618 | A1* | 11/2007 | Sandin | 384/212 |
| 2009/0020655 | A1* | 1/2009 | Biagiotti | 246/387 |
| 2009/0045298 | A1* | 2/2009 | Biagiotti | 246/452 |

FOREIGN PATENT DOCUMENTS

| | | | |
|---|---|---|---|
| DE | 930 528 | C | 7/1955 |
| DE | 10 2004 046339 | B3 | 2/2006 |
| WO | WO 99/20511 | A | 4/1999 |
| WO | WO 2005/083177 | A | 9/2005 |

* cited by examiner

SYSTEM FOR A GREASELESS SWITCH ASSEMBLY

This application claims priority of Provisional Patent Application Ser. No. 60/748,241, filed on Dec. 7, 2005, which is incorporated herein by reference.

FIELD OF THE INVENTION

Exemplary embodiments of the invention are in the field of railroad switching devices, namely, the equipment which is used to displace railroad switch points. More specifically, exemplary embodiments of the invention refer to a greaseless pivoting connector and/or clip.

BACKGROUND OF THE INVENTION

A railroad switch point consists of tapered rail sections that are capable of being selectively displaced between two different lateral positions at a rail switch and then locked in the selected position in order to facilitate the desired routing of a train passing through the switch. The two switch points are typically displaced by rods extending from an assembly that is referred to herein as a "switch machine". Inside the switch machine the rods are usually connected to a motive mechanism which provides reciprocating rectilinear motion controlled by a power unit which is usually placed to one side of the rails.

Such a device is described in Italian Patent No. IT1246656. The device described in that patent operates switch points which are independent, or disconnected, from each other, and it is not applicable to the problem of operating switch points of the interconnected type, i.e. of switch points connected to each other by transverse bars. Switch machines of the interconnected type are shown, for example, in U.S. Pat. Nos. 5,806,809, 6,149,106, and 6,691,958.

The switch machine combines the switch point movement and switch point locking functions into a single mechanism. This reduces mechanical complexity. The switch machine is also enclosed in a weather-proof housing. Also incorporated within the housing are sensors and other electrical control components. The housing and operating assembly are located beneath the switch points and the associated rails.

In such switch machines binding may occur, as described below, when the operating rod does not move along its intended longitudinal line of action. Instead it is subjected to lateral forces tending to cause it to bind at its attachment to the switch point and where the operating rod passes through the switch machine housing. A bearing and a seal are usually provided at the entry point into the housing to align the operating rod and to seal out water and other contaminants. The outer end of each operating rod connects to an associated switch point, and as the operating rod is moved in to and out of the switch machine housing, this substantially longitudinal movement of the operating rod is used to apply force to move the associated switch point laterally. The lateral movement of the switch point requires some change in the angle between the operating rod and the switch point because the switch point is actually pivoting about a pivot point at the other end of the switch point rail section. This change in angle can apply a lateral reactive force on the outer end of the operating rod. This, in turn, causes the inner end of the operating rod to apply substantial lateral force to the bearing and seal mechanism through which the operating rod enters the switch machine housing.

In addition, a more paramount problem that results is due to the thermal expansion of the tongue, or the part that is moved to set the track of the switch. The thermal expansion causes axial motion of the tongue wherein thermal expansion may be more than an inch depending on the temperature and length of the tongue. This lateral reactive force can cause premature failure of the seal and binding of the operating rod relative to the housing, which can cause the switch machine to lock up.

The switch assembly in the prior art requires grease at certain locations to insure smooth operation of the moving parts. Towards this end, regularly scheduled maintenance of the switch assembly must be accomplished to insure that all parts have sufficient grease.

BRIEF DESCRIPTION OF THE INVENTION

Exemplary embodiments of the invention refer to a greaseless pivoting connector and/or clip. More specifically in a railroad switch for use with intersecting railroad rails and having two switch points interconnected by a switch machine between two switch point assemblies and connected thereto by an operating rod at each end of the switch machine, a system for a greaseless switch point assembly having a mounting clip and a pivot pin for connecting each operating rod to its associated switch point is disclosed. The system for the greaseless switch point assembly includes a bushing proximate a part of the pivot pin that fits within an opening in the mounting clip, and an insertion device extending into the opening proximate the bushing.

In another exemplary embodiment, in a railroad switch for use with intersecting railroad rails and having two switch points interconnected by a switch machine between two switch point assemblies and connected thereto by an operating rod at each end of the switch machine, a pivoting connector assembly with a greaseless switch assembly connecting each operating rod to its associated switch point is disclosed. The system for the greaseless switch assembly including a mounting clip having an opening therethrough. A pivot pin that rotatably traverses within the opening is also provided. A bushing fitting proximate a part of the pin that fits within the opening, and an insertion device extending into the opening proximate the bushing creating a surface proximate the opening are also provided. Wherein the bushing moves against the insertion device as the pivot pin is moved.

In yet another exemplary embodiment a system for a switch point assembly for a railroad track switch is disclosed. The system for the switch point assembly includes a mounting clip having an opening therethrough. A pivot pin proximate the opening and rotatably traversable within the opening is further disclosed. Also disclosed are a bushing proximate a part of the pivot pin that is proximate the opening, and an insertion device extending into the opening proximate the bushing.

BRIEF DESCRIPTION OF THE DRAWINGS

A more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

With reference to the figures, exemplary embodiments of the invention will now be described. Exemplary embodiments of the invention are disclosed below specific to a pivoting connector. The scope of the exemplary embodiment of the invention is not limited to a pivoting connector within a switch machine. Specifically, exemplary embodiments of the invention may be implemented in association with other moving parts of a switch machine.

Figure 1:
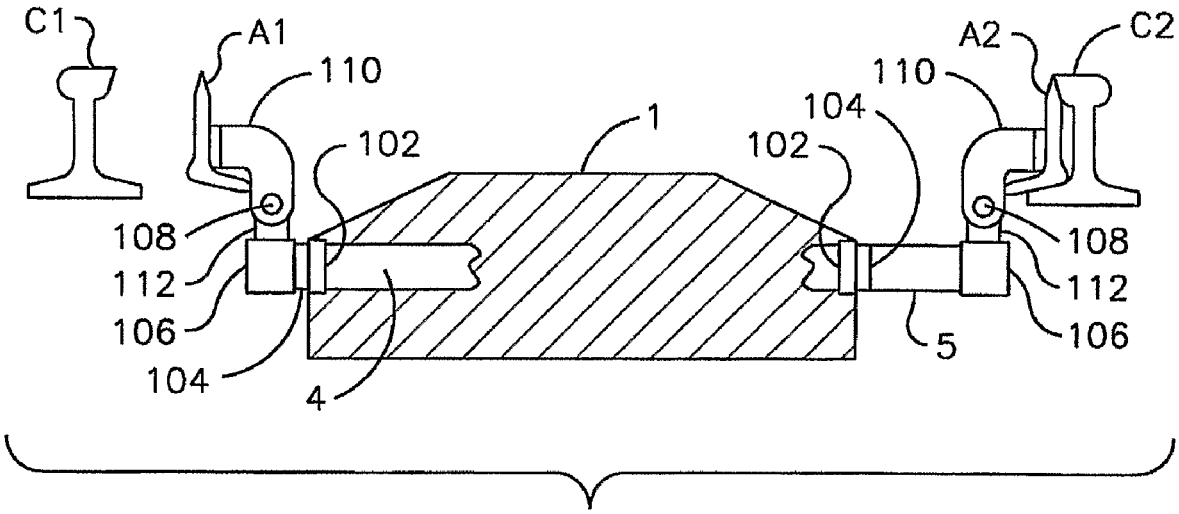
FIG. 1 (PRIOR ART)
FIG. 1 depicts a prior art exemplary illustration of connectors used in a switch machine.

FIG. 1 illustrates a side elevation view of prior art connectors for a switch machine with the switch machine housing 1 itself being shown in section so as to show the location of a bearing 102 and a seal 104 on each operating rod 4, 5. The bearing 102 aligns the operating rod 4, 5 to move along a line of action on the axis of the internal mechanism of the switch machine, while the seal 104 seals out water and other contaminants which could cause deterioration or even malfunctioning of the switch machine. A socket 106 is provided at the outer end of each operating rod 4, 5. Each operating rod socket 106 is pivotably connected to its associated switch point A1, A2, by a yoke 112, a pivot pin 108, and a mounting clip 110. To insure proper operation, grease is applied where the pivot pin 108 and the mounting clip 110 engage each other. The pivot 106 is also used for the alignment between the rod 4, 5 and the tongue A1, A2.

Figure 2:
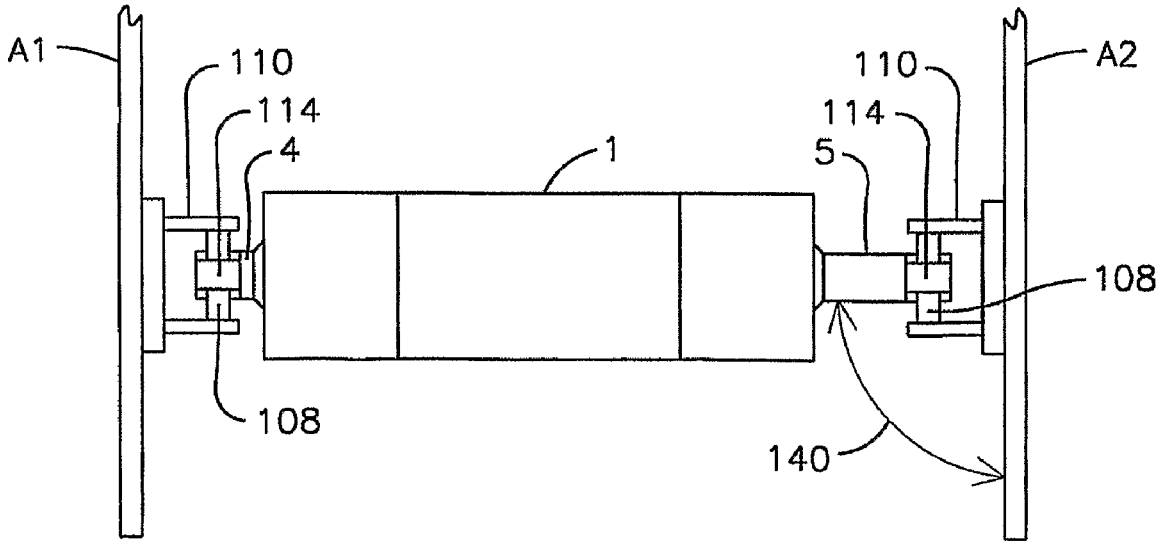
FIG. 2 (PRIOR ART)
FIG. 2 depicts another prior art exemplary embodiment of connectors used in a switch assembly.

FIG. 2 is another prior art illustration. Assume that each switch point A1, A2, along with the respective section of rail to which it is attached pivots around an axis, such as the axis 200 shown in FIG. 3, when the switch point is moved. However, it should be noted that the pivot radius of the rail is relatively large compared to the dimensions of the other elements shown in FIG. 1, and thus the location of the axis 200 is not shown to scale.

Figure 3:
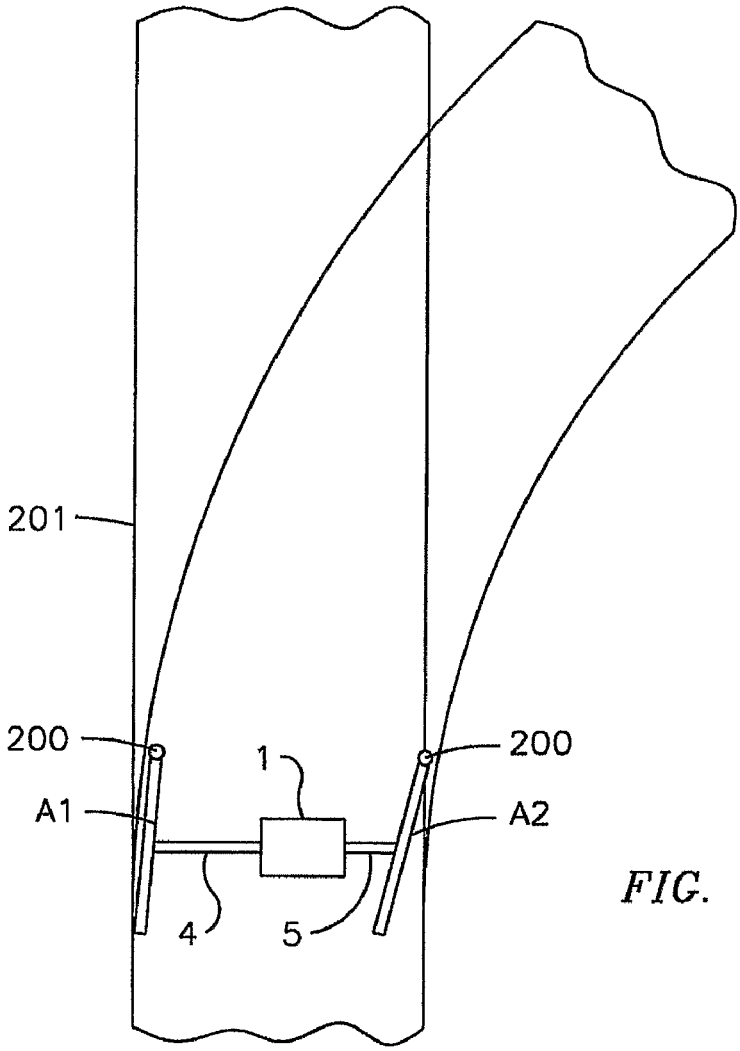
FIG. 3 depicts a schematic top view of a rail layout of a switch point.

As shown in FIGS. 2 and 3, as the operating rod 4, 5 moves longitudinally to move its associated switch point A1, A2 laterally, it can be seen that the angle 140 will change slightly. That is, for example, if the operating rod 5 moves to the right, the angle 140 between the operating rod 5 and the switch point A2 will increase slightly. If the operating rod 5 were locked at a given angle relative to the switch point A2, the lateral reactive force imposed on the operating rod 5 by the pivoting switch point A2 would cause the operating rod to try to pivot in a counter-clockwise direction, as viewed in FIG. 3.

Similarly, if the operating rod 5 were fixedly attached at a given point on the pin 108, pivoting of the switch point would pull the operating rod 5 to one side. These types of lateral or pivoting force on the operating rod 5 would cause it to bind in the bearing 102 and the seal 104. This binding would, at the very least, cause accelerated wear and premature failure of the bearing 102 and the seal 104. Further, this binding could actually lock up the entire switch machine, especially in the case where the two switch points are tied together. However, the connectors are also operative with and provide benefit for other between-the-rail switch machines in which the switch points are not tied together, other than via the operating rods. In the prior art, to assist in preventing wear and premature failure, grease is applied. Applying grease requires periodic inspection and application of grease to be performed.

Figure 4:
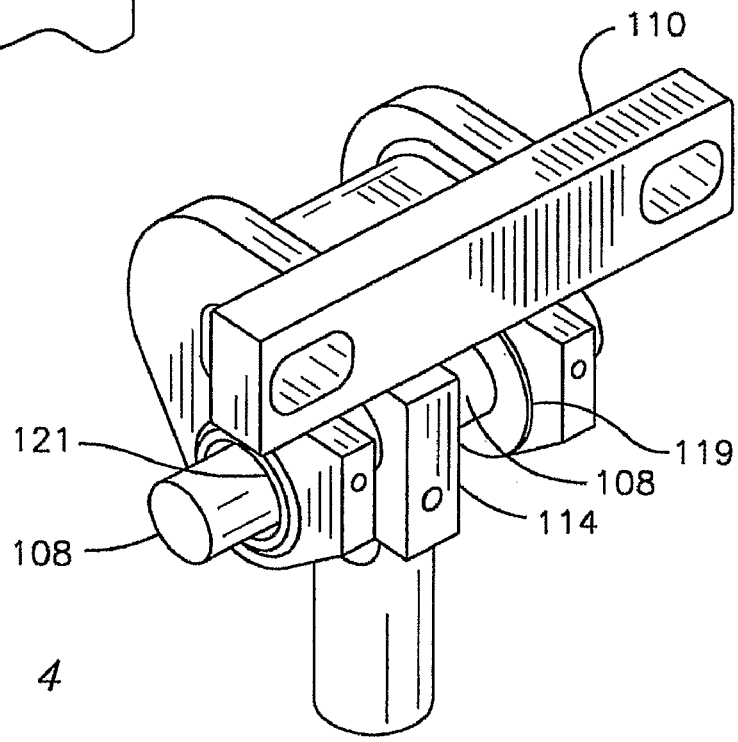
FIG. 4 depicts an exemplary embodiment of the greaseless switch assembly with all elements fitting together.
Figure 5:
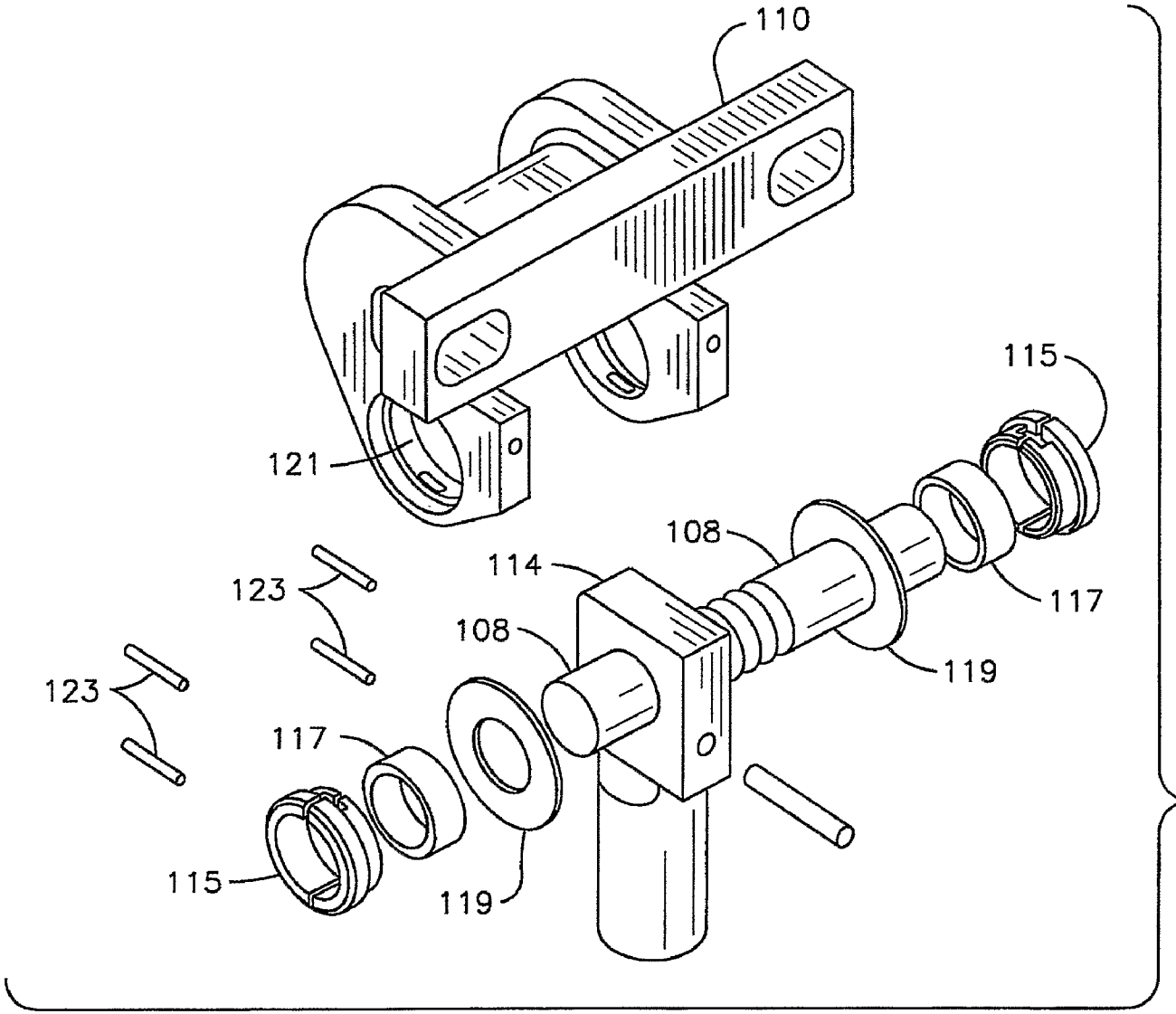
FIG. 5 depicts an exemplary embodiment of the greaseless switch assembly with the elements separated.

FIGS. 4 and 5 are exemplary elevational views of the pivot pin and the mounting clip using a greaseless switch assembly. As illustrated in FIGS. 4 and 5, a mounting clip 110 is provided though which a pin 108 is positioned. The pin fits within or traverses though an opening 121 in the clip 110. To insure continued rotation of the pin 108 within the mounting clip, a bushing 117 is provided.

As illustrated further in FIG. 5, a bushing 117 is provided to allow the sliding of the clip 110 on the pin 108 and also for electrical insulation of the track 201. In the current art, the track 201 has a system to detect the presence of the train. Having the bushing 117 made of plastic avoids a short-circuiting within the switch assembly and/or the railroad track. The washer 119 is used to avoid a short circuit between the clip 110 and a collar 114.

Figure 6:
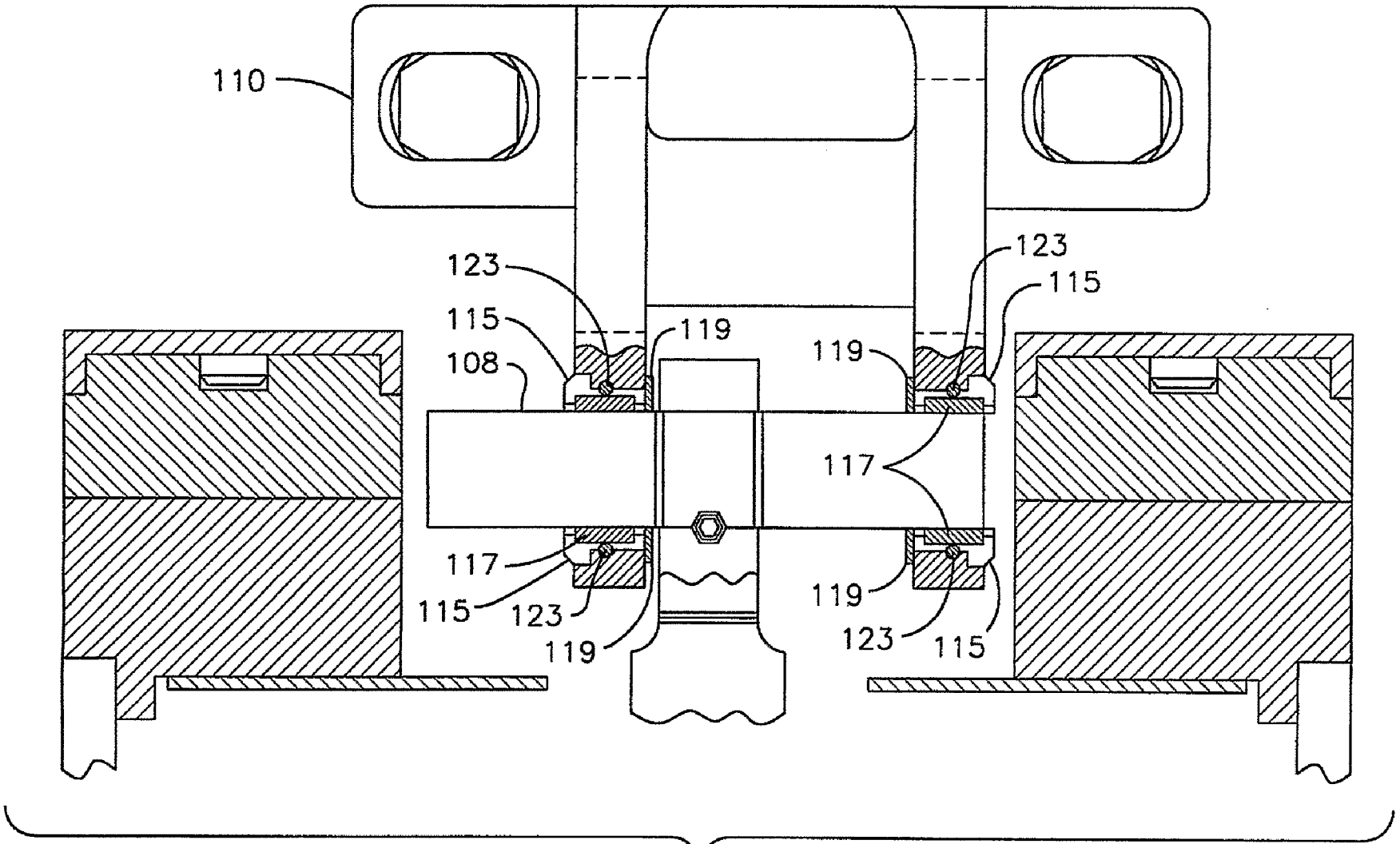
FIG. 6 depicts another elevation view of the greaseless switch assembly.

FIG. 6 depicts another view of the greaseless switch assembly wherein the bushing and washer are disclosed when the pin and clip are placed in a position to allow the switch machine to operate. As further illustrated, insertion devices, mini roller pins, or safety pins, 123 are inserted through the clip 110 wherein the bushing 117 does not contact the inside of the opening 121 within the clip 110, nor an outer securing element 115, but instead rotates against the insertion devices 123. The outer securing element 115, illustrated as being two semi-collars, is provided to prevent the bushing 117 from pulling away from the insertion device 123. As illustrated in an exemplary embodiment, the insertion device 123 is cylindrical in shape so as to allow smooth rotation of the bushing 117 against the insertion device 123.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. In a railroad switch for use with intersecting railroad rails and having two switch points interconnected by a switch machine between two switch point assemblies and connected thereto by an operating rod at each end of the switch machine, a system for a greaseless switch point assembly connecting each operating rod to its associated switch point, the system for the greaseless switch point assembly comprising:

a mounting clip having an opening therethrough;

a pivot pin that rotatably traverses within the opening;

a bushing fitting proximate a part of the pin that fits within the opening;

at least one insertion device extending into the opening proximate the bushing; and wherein the bushing moves against the at least one insertion device as the pivot pin is moved.

2. The system of claim 1 wherein the bushing electrically isolates the pivot pin from the railroad rails.

3. The system of claim 1 further comprising a collar proximate the pivot pin and a washer proximate the collar.

4. The system of claim 3 wherein the washer is positioned to prevent a short circuit from occurring between the mounting clip and the collar.

5. The system of claim 1 wherein each of the at least one insertion device enters the opening at a respective first location and exits the opening at a respective second location.

6. The system of claim 1 wherein the bushing does not contact an inside of the opening within the clip but instead rotates against the at least one insertion device.

* * * * *